United States Patent [19]

Lundstrom et al.

[11] 4,094,364

[45] June 13, 1978

[54] PERCUSSION DRILL ROD

[75] Inventors: Hans Per Olof Lundstrom; Ernst Lennart Johansson, both of Sandviken, Sweden

[73] Assignee: Sandvik Aktiebolag, Sandviken, Sweden

[21] Appl. No.: 483,045

[22] Filed: Jun. 25, 1974

[30] Foreign Application Priority Data

Jul. 5, 1973 Switzerland ..... 7309455

[51] Int. Cl.[2] ..... E21B 1/06

[52] U.S. Cl. ..... 173/80; 173/126; 175/293

[58] Field of Search ..... 173/80, 102, 126; 166/241; 175/173, 293, 56

[56] References Cited

U.S. PATENT DOCUMENTS

| | | | |
|---|---|---|---|
| 349,192 | 9/1886 | Woodhouse | 308/4 A |
| 1,006,661 | 10/1911 | Knapp | 175/56 |
| 1,559,709 | 11/1925 | Knapp | 175/56 |
| 1,583,262 | 5/1926 | Smith | 308/4 A |
| 1,868,684 | 7/1932 | Bayles | 173/80 |
| 2,188,119 | 1/1940 | Prentice | 166/241 |
| 2,725,264 | 11/1955 | Bodine, Jr. | 308/4 A |
| 3,720,272 | 3/1973 | Hunter | 175/173 |

*Primary Examiner*—Ernest R. Purser
*Assistant Examiner*—William F. Pate, III
*Attorney, Agent, or Firm*—Burns, Doane, Swecker & Mathis

[57] ABSTRACT

In the percussion drill rod assembly of the present invention rotary force is transmitted through a tubular member of the assembly while impact force is transmitted through the rod member centrally located in the tubular member. Either of said rod and tubular members is provided with radially extending protrusions which guide said member with respect to the other member while enabling flushing medium to pass between said members.

1 Claim, 6 Drawing Figures

PERCUSSION DRILL ROD

This invention relates to percussion drill rods, and is concerned more particularly with a drill rod comprising a plurality of rod members mounted in end-to-end relation and a plurality of tubular members extending concentrically around said members.

Extension drill steel equipment for a percussive type drilling machine normally consists of: a shank adapter, coupling sleeves, extension rods and a bit. These components are joined together with screw threads. There are, however, several disadvantages associated with such drill steel equipment adapted to transmit both impact and rotary forces therethrough. For example, tests have shown that with these coupling sleeves there is a considerable loss of energy in transmitting an impact force through such a drill steel. Due to said coupling sleeves the drill steel unit will be unequal in diameter throughout its length which impairs its shock wave transmission capacity; also, this rod structure is detrimental to the possibility of effectively blowing drill cuttings back along the exterior of said rods. Since the threads have to transmit the shock waves of the drill from the shank adapter to the bit they are subjected to severe stresses, which make heavy demands on their strength, wear resistance and transmission capacity. It is also necessary that the connections be easy to connect and to dismantle.

One object of the present invention is to provide a new and improved percussion drill rod which is not encumbered with the disadvantages related above. To this end there is provided a percussion drill rod assembly in which rotary force is transmitted through one member tubular in shape and the impact force is transmitted through one rod member centrally located therein. This drill rod according to the invention is characterized in that either of said rod and tubular members is provided with protusions which extend in several radial directions so that said member is positively guided relative to the other member thus enabling flushing medium to pass between said members and thereby pass between said radial extensions. With this particular configuration of drill steel members it will be possible to minimize the loss of energy in transmitting an impact force therethrough and, simultaneously, to attain greatly improved possibilities of flush medium transmission and thus to enable a higher penetration rate.

The invention will now be described in detail with reference to the accompanying drawings, additional characteristic features of the invention being made apparent in connection therewith:

By "drill rod" referred to in this description and in the appended claims is to be understood the drill string disposed between the drill bit and the drilling machine.

Figure 1:
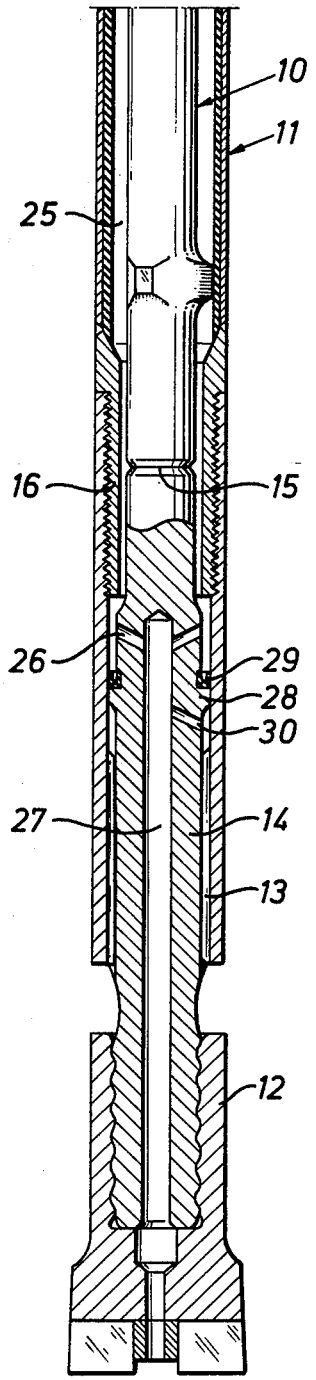
FIG. 1 is a longitudinal section elevation showing of one embodiment of the invention.
Figure 2:
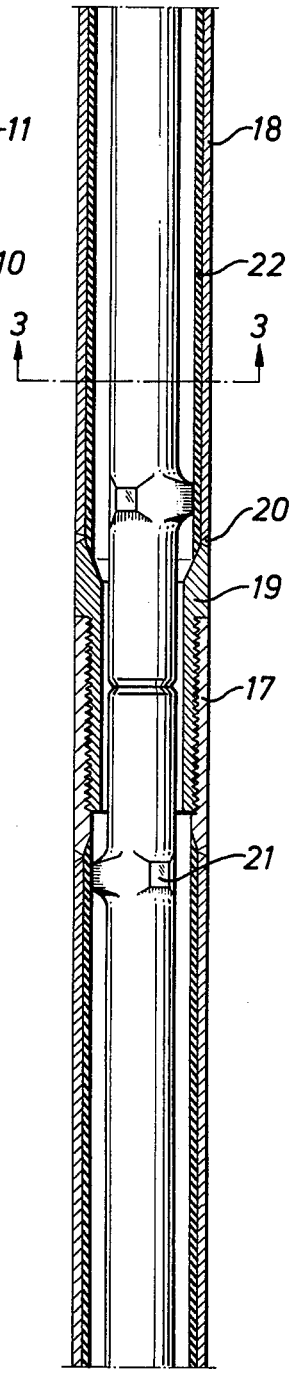
FIG. 2 is a continuation of FIG. 1.
Figure 4:
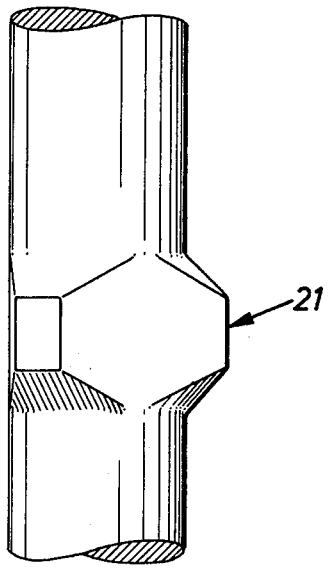
FIGS. 4 and 5 are side views of the rod member embodying the principles of the invention.

Referring to FIGS. 1 and 2, an elongated drill rod comprises one or several rod members 10, and a plurality of tubular members 11 concentrically disposed therearound, said first members being massive and of circular cross section and said last members being joined together with screw threads or some other suitable type of connection. The lower end section of the drill rod is adapted to receive a drill bit 12. To this end the lowermost tubular section, as shown in FIG. 1, is interiorly splined at 13 for connection with the splines on the shank 14 of the bit 12. It is to be understood, however, that the bit could be integral with shank 14, or that shank 14 and said tubular section could be joined together with some other type of connection.

The inner rod members are adapted to transmit impact force, and are for that purpose mounted in end-to-end relation. The end surfaces 15 thereof are suitably plane but they may have some other shape, for instance conical.

In the embodiment shown in the drawings each tubular member 11 is exteriorly threaded at its lower end portion 16 and interiorly threaded at its upper end portion 17, which portions for this purpose have been formed by upsetting (forging). Between the threaded portions said tubular member has a cylindrical portion 18 with a uniform wall thickness, said portion comprising the main part of the length of said member. These threaded end portions might be forged integrally in one piece with the appertaining tubular member but they are suitably provided as separate sleeve members 19 fastened to said members by welding, as shown at 20. The external mantle surface of a plurality of such coupled tubular members is even and has the same external diameter along its whole length, so that the cuttings have a free passage along the outside thereof.

Figure 3:
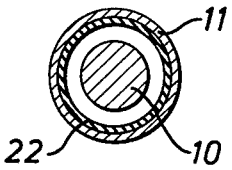
FIG. 3 is a cross-sectional view of FIG. 2, taken along the line 3—3.
Figure 5:
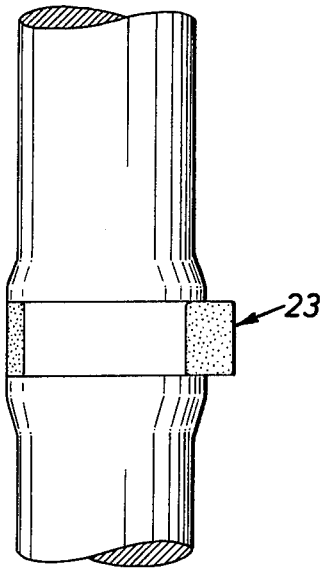
Figure 6:
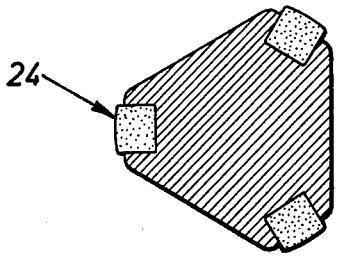
FIG. 6 is a cross-sectional view of the rod member showing the details of providing separate guide members thereto for damping purposes.

In order to have the rod members 10 guided radially and axially inside the tubular members 11 said first members are provided with protrusions 21 which extend radially in several directions, as shown in the drawing. These protrusions are adapted to be guided against the internal surface of the tubular member 11, for instance via a damping layer 22 of rubber or similar material which might be secured to said member 11 by vulcanization. Alternatively, the protrusions 21 may be provided on apertured rings 23 (see FIG. 5) of rubber, plastic material or the like, such rings being shrink-fitted on the rod members 10 and/or received in a groove around said members, such as shown in FIG. 5. Although shown provided only interiorly of said tubular members in FIGS. 1–3 the rubber or similar damping material could be provided exteriorly on the rod members 10. Thus, bits or inserts 24 of rubber or similar could be received in correspondingly shaped recesses on said protrusions 21 as shown in FIG. 6, thus having members 10 and 11 isolated from each other and a good damping capacity built in with such drill rod.

In principle it is a matter of indifference whether the radially extending protrusions are provided exteriorly on the rod or inside the tubular members. Thus, although shown on rod members 10 they could be interiorly provided on said tubular members 11 formed as apertured rings with an unequal inner diameter shrink-fitted in said member 11. For practical reasons, however, said protrusions are provided on said rod members 10 by upsetting (forging) as shown in the figures.

Flushing medium, usually air or water, is to be lead through the annular space 25 between rod members 10 and tubular members 11. Due to such arrangement, it will be possible to submit larger amounts of flushing medium to the drill hole than what has been possible with rod structures known heretofore, thus enabling a higher penetration rate. Further, the centrally disposed rod members may be of massive structure thus enabling a higher fatigue resistance thereof. The bit 12 will be provided with flushing medium from said annular space 25 via one or several channels 26, said last channels being provided laterally extending in the shank 14 at an acute angle thereto. The flushing medium is then submitted to the bit 12 through a centrally disposed flushing channel 27, this being of a known construction.

In order to limit the longitudinal movement of a rod member 10, the shank 14 is provided with an annular collar 28 or similar means. For the purpose of attaining a safely tightened location of the shank 14 in the lower end section of the foremost tubular member 11 an annular sealing ring 29 is received in a corresponding annular groove in said shank 14 adjacent said collar 28. The shank 14 is provided with another lateral channel 30 communicating with the space between the collar 28 and the splines 13 so as to prevent drill cuttings from penetrating and blocking said splined connection.

This particular design of drill rod structure also provides for applying a higher speed of air under pressure to blow cuttings away along the outside of the drill rod, thus enabling a higher penetration rate.

From the foregoing it is clear that the drill rod according to the invention is formed to cause as small losses as possible in the transfer of energy from the drilling machine to the drill bit. This is so because there are no threaded couplings to reflect shock waves transmitted through the drill rod. A higher penetration rate will be attainable because of the improved possibilities of flushing medium transmission. The drill rod of the invention furthermore provides for effective noise suppression. The impact force transmitting rod members can be massive with a few or no fractural impressions and without any threads thereon, which positively adds to the durability. A very small heat development has been obtained with the impact transmitting rod members which also adds to durability. The threaded connections of the tubular members will be subject only to torque transmission when drawing up the drill rod from the drill hole, which implies that they need not be as wear resistant as those threads adapted for conventional precussion drill rods provided they are easy to connect and to dismantle.

We claim:

1. Drill rod structure for use with a percussive-type rock drilling machine comprising, a plurality of rod members (10);

a plurality of tubular members (11) connected to each other, said tubular members being disposed around said rod members leaving a space (25) between them and said rod members;

a drill bit (12) having a shank (14) provided with a force-receiving surface;

said rod members being massive and loosely mounted in end abutment with each other to transmit only longitudinal forces to said drill bit;

said tubular members being rotatably connected to the drilling machine at one end portion and having a slideable interlocking connection (13) with said shank at the opposite end portion to transmit only rotational forces to said bit shank;

said bit shank also having means (28) to prevent said shank and bit from sliding out of said tubular members;

either of said rod and tubular members being provided with protrusions (21) extending in several directions to function as guides and to provide passageway for flushing medium to pass through said space and thereby also to pass between said protrusions, said slideable interlocking connection consisting of splines connecting said bit shank with the foremost tubular member, said bit shank being provided with a centrally extending flushing channel (27) and at least one channel (26) extending laterally at an acute angle from and in communication with said first channel and with the aforesaid space.

* * * * *